US005823213A

United States Patent [19]

Patarra

[11] Patent Number: 5,823,213

[45] Date of Patent: Oct. 20, 1998

[54] COMBINATION PURSE AND UMBRELLA

[76] Inventor: Samuel F. Patarra, 111 Elysium Dr., Royal Palm Beach, Fla. 33441

[21] Appl. No.: 862,998

[22] Filed: May 27, 1997

[51] Int. Cl.[6] ..... A45B 3/10

[52] U.S. Cl. ..... 135/16; 135/22; 135/25.1; 135/25.31; 150/106

[58] Field of Search ..... 135/16, 15.1, 25.1, 135/25.3, 25.31, 22, 25.34; 150/106, 112

[56] References Cited

U.S. PATENT DOCUMENTS

| | | | |
|---|---|---|---|
| 892,813 | 7/1908 | Dolles | 135/25.31 |
| 1,820,639 | 8/1931 | Weise | 135/22 |
| 1,824,192 | 9/1931 | Bouma . | |
| 1,908,453 | 5/1933 | Schmidt | 135/25.31 X |
| 2,150,971 | 3/1939 | Heilmann et al. | 135/25.31 |
| 2,220,900 | 11/1940 | Halstead | 135/47 |
| 2,289,134 | 7/1942 | Loria | 135/16 |
| 2,682,904 | 7/1954 | Divine | 150/28 |
| 2,788,792 | 4/1957 | Koller | 135/20 |
| 2,864,389 | 12/1958 | Smith et al. | 135/2 |
| 3,730,197 | 5/1973 | Lunney | 135/16 |
| 4,041,966 | 8/1977 | Sakurai | 135/22 |
| 4,832,163 | 5/1989 | Levesque | 135/16 X |

*Primary Examiner*—Lanna Mai
*Assistant Examiner*—Winnie S. Yip
*Attorney, Agent, or Firm*—Oltman, Flynn & Kubler

[57] ABSTRACT

The combination of an umbrella and purse comprising a main mast, a flexible umbrella frame operatively arranged at one end of the mast, means to maintain the flexible frame of the umbrella in spaced apart stand-off relation with respect to the main mast when the umbrella is collapsed and lowered, a purse arranged at the opposite end of the mast and surrounding it, the distance of the side walls of the purse from the mast and the distance at which the flexible frame of the umbrella is maintained from the mast by the spacing stand-off means being approximately equal to permit the flexible umbrella frame to surround the purse.

10 Claims, 3 Drawing Sheets

COMBINATION PURSE AND UMBRELLA

FIELD OF THE INVENTION

This invention relates to a novel combination umbrella and purse.

BACKGROUND OF THE INVENTION

Telescopically collapsible umbrellas have been in use before in this art. In the ordinary umbrella, such as is well known in the art, the usual light folding flexible frame of spring steel ribs is disposed in "spoke-like" arrangement to form a supporting frame which is usually covered with a rain and sun resisting fabric or other flexible material suitably fastened thereto. A slotted ferrule slides up and down the mast and carries ribs which are pivotally connected to the fabric supporting ribs, as well as to the ferrule. Spring latch means protrude, and are urged outwardly, from the mast at suitable places. One latch is located near the upper end of the mast, over which the ferrule passes, and engages the under side of the ferrule to maintain the umbrella in open or raised position. Another spring latch is located toward the lower end of the mast, adapted to protrude through the slot of the ferrule and maintain the umbrella in closed or collapsed position.

SUMMARY OF THE INVENTION

In the present invention, a novel means is provided to maintain the light flexible umbrella frame and fabric cover in juxtaposed stand off and uniformly spaced apart position with relation to the main mast of the umbrella. This most important feature is required to permit the umbrella frame and cover to enfold and surround the purse gracefully and compactly.

The principal object of this invention is to provide a novel purse or handbag which is combined in one unit with an umbrella of novel design, the supporting mast of the umbrella being adapted to telescope within the purse when the umbrella is closed in a manner whereby the fabric of the umbrella surrounds and envelops a portion of the purse.

Another object of the present invention is to provide a unitary combination umbrella and purse or handbag which is easy to open and close, and presents an attractive appearance in either open or closed position.

A further object is to provide, in a combined umbrella and handbag, a novel arrangement of operating elements which is of low cost to manufacture, has a minimum of working parts, and which is easy to assemble, durable and requires little maintenance in use.

A still further object is to provide a novel combined unitary umbrella and purse which is semi-automatic in opening and closing action.

Still another object is to provide, in a dual purpose umbrella and ladies handbag, novel means to maintain the ribs of the light flexible frame and covering fabric in an even juxtaposed stand-off position with relation to the central telescopic supporting mast of the umbrella when it is collapsed so that it may envelop and surround the purse in an attractive manner and which provides a shorter mast and more compact structure over all.

Another object is to provide spring actuated, easily operated, manually releasable, snap locking means in a combination telescoping umbrella and purse, which maintains the umbrella in both positive open raised position above the purse, or in positive collapsed position, with the frame and fabric evenly surrounding the purse.

Another object is to provide a modified form of combined umbrella and purse comprising a novel and useful arrangement of parts, whereby the entire umbrella, including its supporting frame and cover fabric, may be telescoped and collapsed when lowered and closed and folded completely within a central container disposed within the purse in a compact manner providing a large remaining space within the purse for receiving objects to be carried.

Further objects and advantages of this invention will be apparent from the following detailed description of a presently preferred embodiment, shown schematically in the accompanying drawings.

DETAILED DESCRIPTION

Figure 1:
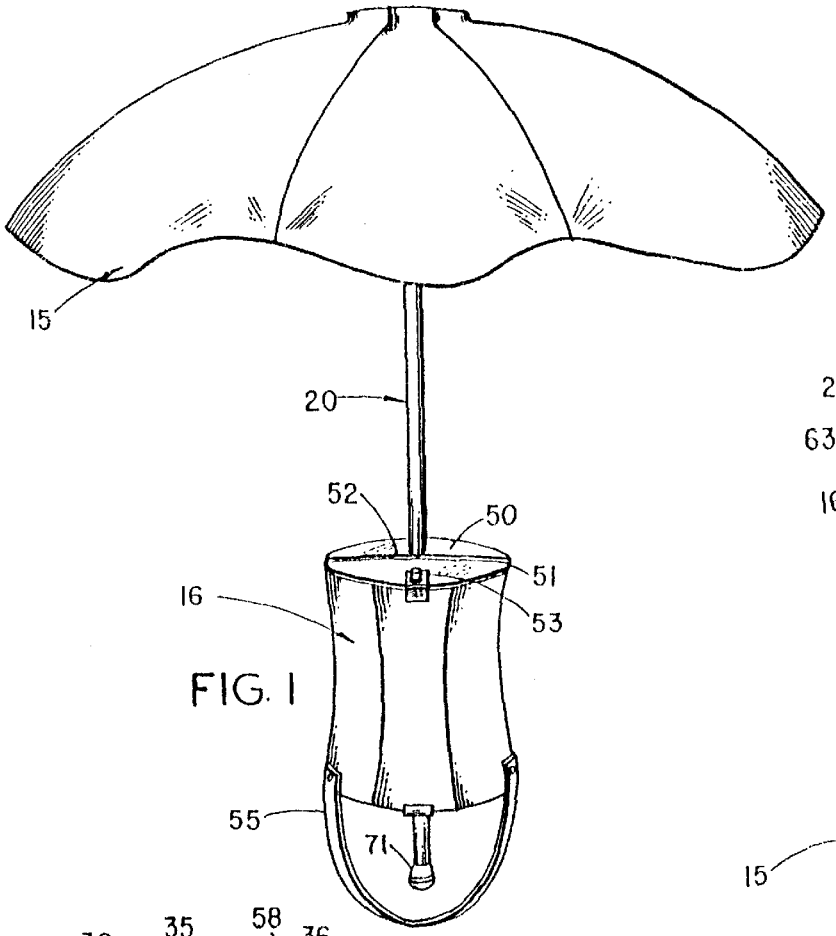
FIG. 1 is a perspective view of the preferred form of the combined umbrella and purse of this invention shown with the umbrella in open position.

Before explaining the disclosed embodiment of the present invention in detail it is to be understood that the invention is not limited in its application to the details of the particular arrangement shown, since the invention is capable of other embodiments. Also, the terminology used herein is for the purpose of description and not of limitation.

Referring now to the drawings in detail in which like parts are designated by like numerals throughout the several views, the umbrella portion of this invention, which consists of a light folded frame, covered with fabric or other suitable material which acts to protect against rain or sun, is indicated in general by the numeral 15, and the purse or handbag portion is indicated generally by the numeral 16. See FIGS. 1 and 2 in particular.

A hollow tubular main supporting mast is designated by the numeral 20, and supports the umbrella 15 when in open position. This main mast 20, which passes through and is operatively associated with the purse 16, as will be hereinafter described, connects the purse 16 and umbrella 15, as shown in FIG. 1.

The mast 20 comprises the two parts, one an upper shaft or hollow tube 21 which is telescopically assembled within a lower hollow tubular outer supporting shaft 22, and slidable therein for the purpose and in a manner to be described hereinafter.

The novel stand off means comprises a pair of stand off discs, the upper one being number 30 in the drawings and the lower one numbered 40. See FIGS. 3, 4, 5 and 6. These discs may be of plastic, metal or other rigid material.

The upper disc 30 has a central hole 31 which receives the upper end of the upper shaft 21 and is immovably fixed thereto by a pin or screw 32 of plastic such as polyethylene or any other suitable fastening means not shown in the drawings. The diameter of the stand off discs 30 and 40 is variable, depending on the diameter of the purse 16, but can be 4 to 8 inches in practice.

The purse/umbrella can stand on the disc 30. There may be a flat plug at the center of the disc (not shown) to keep water out. Ribs 33 are pivotally mounted at their inner ends on the disc 30 in any desired manner as at 34, on a peripheral wire ring 35 which is located in a groove 36 surrounding the stand-off disc 30, as shown in FIGS. 3, 4, 5 and 6 of the drawings. The ribs 33 extend radially outwardly from the stand-off disc and may be six, eight, or more in number. The ribs 33 are preferably of spring steel, flexible and light in weight and of a length required to reach the outer periphery of the fabric cover. This is determined by the diameter of cover desired, and the cover is fixed to the outer end of each rib, in a manner which is well known in the art.

The lower stand-off disc 40 is the same as its counterpart, upper disc 30 hereinabove described, having a peripheral groove 46, which seats a wire ring 45, fixed thereto. Short ribs 43 are pivotally mounted at their inner ends on the disc 40, in any desired manner, such as on the wire ring 45 at 44. The outer ends of the short ribs 43 are pivotally connected at 47 to the cover supporting ribs 33, one short rib 43 for each cover supporting rib 33 whether there be six, eight or any other desired number.

The lower stand-off disc 40 has a central hole 41 which receives the upper shaft 21 and is slidable thereon and serves as a runner. Disc 40 is fixed to a ferrule 48 which is also slidable on the inner shaft 21, as shown in FIGS. 3, 4, 5 and 6 of the drawings.

Raising and lowering the lower disc 40 and the ferrule 48 on which it is mounted by sliding it up and down upper shaft 21 will obviously raise and lower the umbrella 15.

Figure 3:
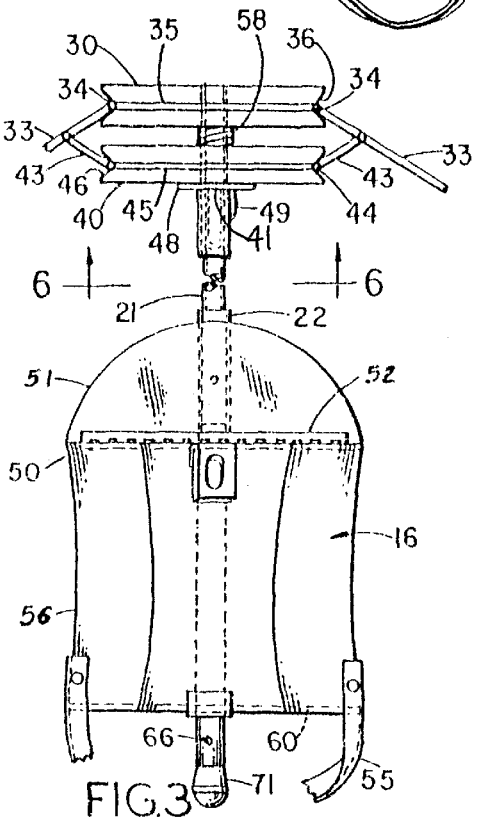
FIG. 3 is a side detail fragmentary view, partially in cross-section, of the umbrella and purse combination, illustrated in FIGS. 1 and 2, the fabric of the umbrella being omitted to disclose the arrangement of some of the operating elements when the umbrella is in open position, particularly the stand-off means.
Figure 6:
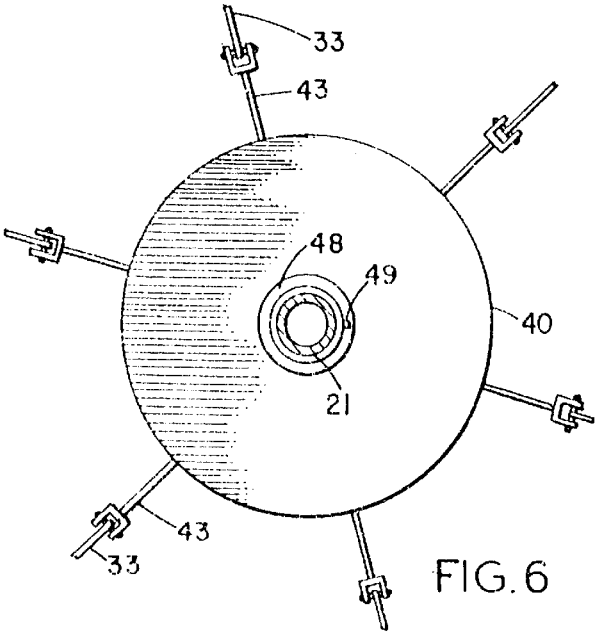
FIG. 6 is an enlarged detail bottom view of the central stay-supporting disc, taken on the line 6—6 of FIG. 3 looking in the direction indicated by the arrows.

A conventional outwardly urged spring pressed latch 49 is adapted to support the bottom edge of ferrule 48, as shown in FIGS. 3 and 6 of the drawings in the conventional manner common to known umbrellas.

A coil compression spring 58 is mounted on the shaft 21 in a manner to be compressed between the fixed upper stand-off disc 30 and the slidable lower stand-off disc 40 when the umbrella 15 is locked in open position, as shown in FIG. 3. This spring 58 expands when latch 49 is manually compressed to permit the ferrule 48, which is fixed to stand-off disc 40, to slide downwardly on shaft 21, and the action of spring 58 assists and boosts the separation of stand-off discs 30 and 40 and the lowering or collapsing of the umbrella.

This arrangement, particularly the stand-off discs 30 and 40, permit the long ribs 33 of the light spring metal frame and its covering fabric which form the umbrella 15 to be closed about the outside of t he purse or handbag 16. This important feature aligns the long ribs 33 parallel, or approximately parallel, to the mast 20 but in even space apart relation thereto, as shown in the drawings.

The pair of stand-off members 30 and 40 may be other than disc form if desired. They may be square, rectangular, triangular or any other shape and perform the same novel function. A spider or spoke shaped member may be substituted for discs 30 and 40, or for one of them, as desired, and perform the function of this invention. They may be made of any material.

The handbag or purse 16 may similarly be of any desired shape or size. The one shown is cylindrical only for purposes of illustration. The shape, design and size of the handbag or purse 16, in combination with the design and size of the stand-off members 30 and 40, determines the plane of alignment of the long ribs 33 in relation to the mast 20; that is, they may be parallel or otherwise.

Figure 2:
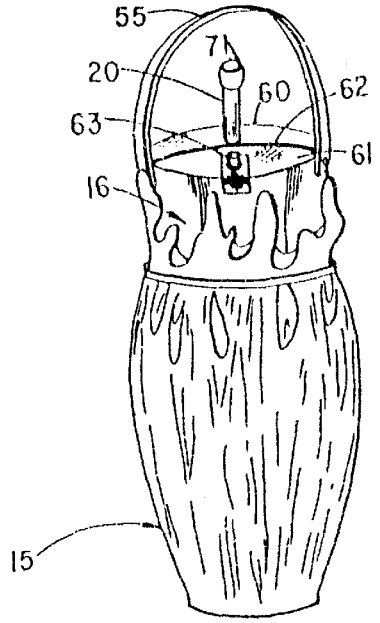
FIG. 2 is a perspective view of the combined umbrella and purse shown in FIG. 1, illustrating the umbrella in closed position.

The purse 16, illustrated, comprises a top 50, which has a hinged to lid 51 of any desired construction. A hinge 52 permits the top lid to be opened or closed providing access to the purse 16 when the umbrella portion 15 is in raised position, as shown in FIGS. 1 and 3. A suitable fastener of any type, such as a turnbuckle or spring clip 53, is provided to maintain the lid 51 of top 50 of the purse 16 in closed position when the umbrella portion is lowered and carried in the reverse position, as shown in FIG. 2. A suitable carrying strap 55 is fixed by any desired means to side walls 56 of the purse to facilitate carrying by hand or over the user's arm.

A bottom 60, which has a hinged bottom lid 61 of any desired construction, is provided at the bottom of the purse 16. This bottom 60 and lid 61 provide access to the purse 16 when the umbrella is closed or collapsed about the purse 16 and reversed in position, as shown in FIG. 2. A hinge 62 and fastener 63 are provided which are similar to the hinge 52 and fastener 53 of the top lid 51.

The lower section 22 of the mast 20, in the form shown in the drawings, is fixedly mounted within the center of purse 16 by a ring 65 which may be welded or fixed by adhesive to the bottom 60 of the purse. Rivets 64 may be used or any conventional means of fixing the lower section 22 immovably to the purse 16. If desired, as an alternative, the purse 16 may be slidably mounted to permit limited slidable travel on the mast 20 to accommodate a variety of means for securing ribs 33 in close contact surrounding the purse. This contemplates use of a closure ring (not shown) surrounding the bottom 60 of the purse. When the umbrella is in closed position, as in FIG. 2, this closure ring will surround and contain the outer ends of the ribs. When n this position, the bottom 60 becomes the top of the purse, as previously described.

Figure 5:
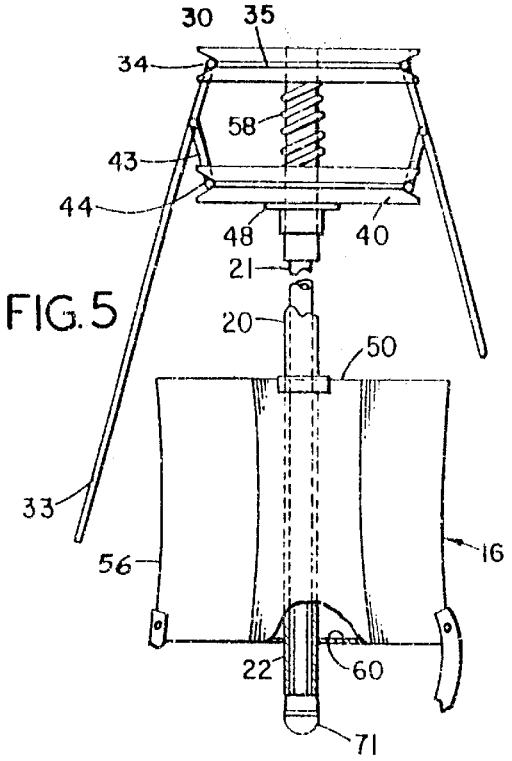
FIG. 5 is a side detail fragmentary view, similar to FIGS. 3 and 4, partially in cross-section, illustrating the arrangement of the operating elements when the umbrella is in completely closed position.

The lower section 22 is a hollow tube having a slightly larger internal diameter than the external diameter of the upper section 21 of mast 20 to receive and permit easy telescoping of the upper section 21 within the lower section 22 after the umbrella has been collapsed. Thus, the umbrella frame and cover will surround and envelop the purse, and the mast 20 will be shortened, as shown in FIGS. 2 and 5, disappearing nearly entirely within the purse portion of the device.

A locking button 66 protrudes through a hole 67 in the upper section 21 of the mast 20, spring 68 being suitably arranged within the tubular section 21 to press the locking button outwardly. The spring is shown in changed positions.

Figure 7:
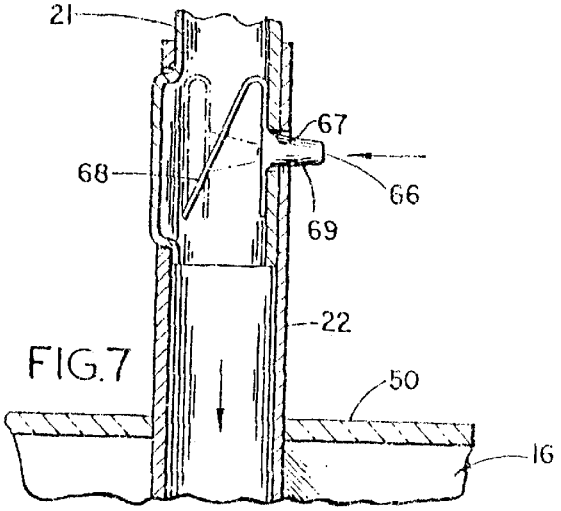
FIG. 7 is an enlarged fragmentary detail cross-section side view of a spring urged snap lock device and the telescoping shafts shown in position for holding the umbrella open.
Figure 4:
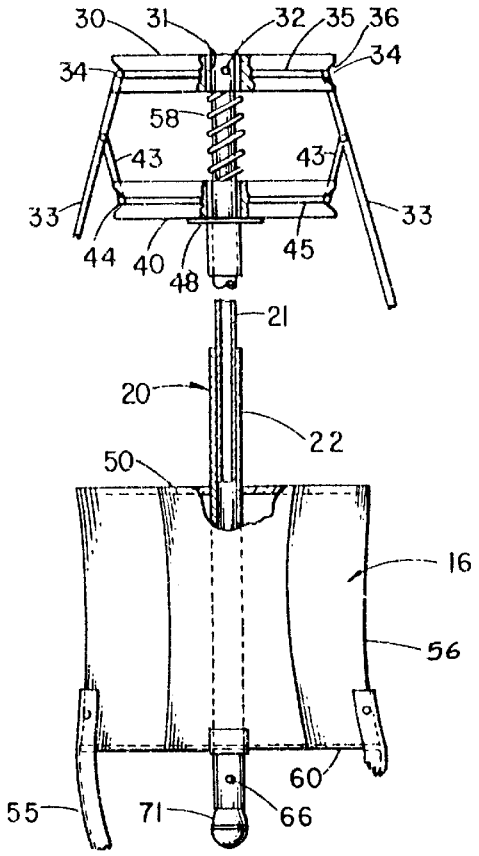
FIG. 4 is a side detail fragmentary view, similar to FIG. 3, partially in cross section, illustrating the arrangement of some of the operating elements when the umbrella is in partially closed intermediate position, before telescoping of the shaft.

When the mast 20 is fully extended upwardly and the umbrella 15 is raised, as shown in FIGS. 1 and 3, the locking button 66 protrudes through hole 69 located in that portion of the lower section 22 which extends above the top 50 of the purse 16, as clearly shown in FIG. 7. This snap action locking means maintains upper section 21 of the umbrella in raised position.

Figure 8:
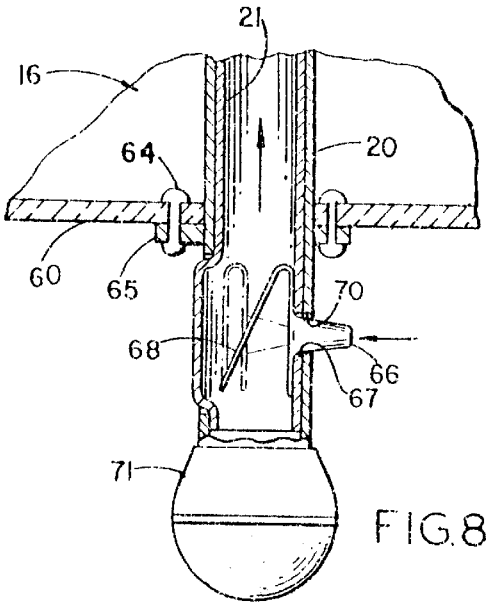
FIG. 8 is an enlarged fragmentary detail cross-sectional view of the spring urged snap lock device, and the telescoping shafts, illustrated in FIG. 7, shown in position for holding the umbrella closed.

When the two sections 21 and 22 of mast 20 are fully telescoped together, in completely closed position, the spring pressed locking button 66 is caused to protrude outwardly through hole 70 located in the handle portion 71 of the lower section 22 which extends below the bottom 60 of the purse 16, as well as through hole 67 in Section 21. This is clearly shown in FIG. 8.

It is thus apparent that the upper section 21 and lower section 22 of mast 20 are held in positive snap locked extended or contracted position in their telescopic relationship, as desired by the user.

It is to be understood that this invention contemplates the use of any other desirable means of maintaining the telescopic mast 20 in extended or contracted position.

The operation of this novel combination purse 16 and umbrella 15 is easy for the user, and positive in action.

The device may be in completely closed position, inverted as shown in FIG. 2 for carrying on the arm or in the hand of the user by means of strap 55. When a user desires to raise and open the umbrella 15, the user simply reverses the position of the device end for end from that shown in FIG. 2, and grasping handle 71 presses locking button 66 inwardly to release it from its engagement with lower hole 70 of the handle 71 and moves the upper section 21 of mast 20 upwardly until the locking button 66 engages upper hole 69 of that portion of section 22 of the mast, which is disposed above the top 50 of the purse. This extends the telescoped mast 20 to fully extended position and locks it in said position. See FIGS. 1, 3, 7 and 8. That completes the first step in the raising and opening operation.

The next step is performed by grasping the ferrule 48 which is fixed to the underside of the set-off disc 40 and pushing it upwardly on section 21 of the mast, compressing spring 58 which separates discs 30 and 40, until the spring pressed element 49 is overridden by ferrule 48 and disc 40. When the bottom edge of ferrule 48 passes the spring element 49, said element snaps outwardly and supports and locks lower set-off discs 40 in raised position, as clearly shown in FIGS. 1 and 3.

Figure 9:
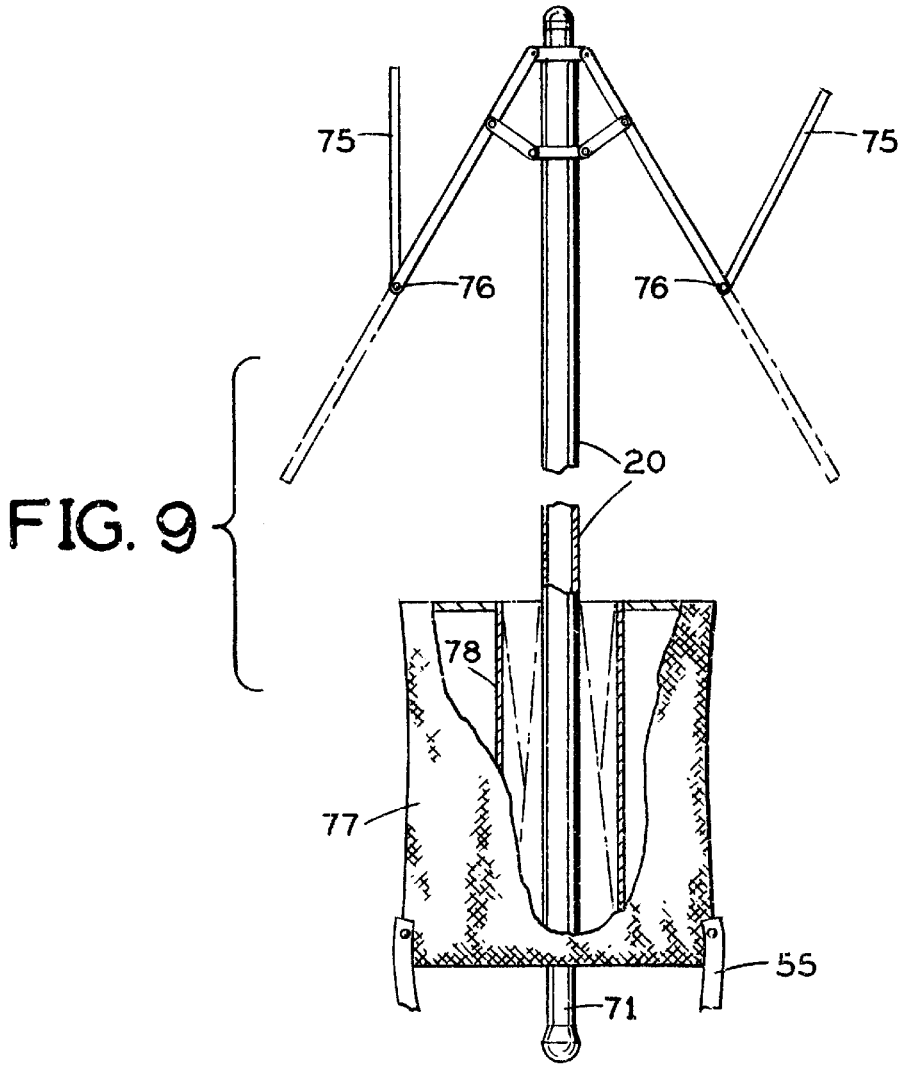
FIG. 9 is a fragmentary schematic side view, partially in section of a modified form of this invention, shown with a folding umbrella in partially open position, the fabric of the umbrella being omitted for purposes of illustration of the operating elements including the container for receiving the folded umbrella.

An alternative form of this invention is schematically illustrated in FIG. 9. In this form, a conventional, well known type of folding umbrella is used. The long ribs 75 being reversely pivoted at approximately their center 76, as shown. The frame of this type folds back upon itself, making a resulting compact pack which may be drawn completely into the purse 77 and into a centrally located cylindrical container 78, which is suitably mounted within the purse.

Figure 10:
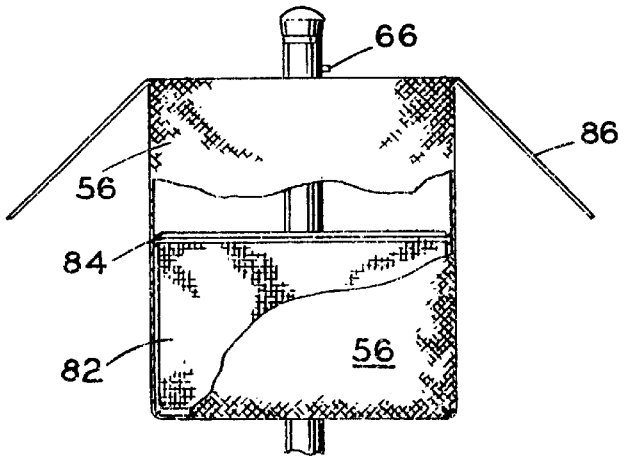
FIG. 10 schematically shows a pouch in the first embodiment.

As shown in FIG. 10, in the first embodiment, the inner part of the purse has a continuous pouch 82 with a zipper 84 running all the way around it and another zipper on the inside of it running all the way around. The pouch will be attached one-half the way down the purse allowing the pouch to turn up or down. A cover 86 is provided for covering the umbrella pin ends.

It should be noted that the umbrella coverings are interchangeable so that coverings of different colors and patterns may be used.

I claim:

1. A combination umbrella and purse, including a support mast, a purse arranged at one end of said support mast, a foldable umbrella arranged at the opposite end of said mast, said umbrella having a plurality of fabric supporting ribs forming a frame, a fabric covering extended over and fixed to said frame which folds to an open position and to a closed position, and means for maintaining said frame in spaced apart stand-off relation with respect to said mast and such that said frame surrounding the purse when the umbrella frame is in said closed position, and said purse having carrying means on one end in said opposite end of the support mast for carrying the umbrella in a lowered and reversed position.

2. A combination umbrella and purse, as described in claim 1, wherein the mast is formed of first and second elements, said first element being at least partly hollow and said second element being slidably mounted within said first element, said first and second elements being adapted for telescoping together one within the other.

3. A combination umbrella and purse, as described in claim 1, wherein the stand-off means comprises two discs, one fixed to the upper end of the mast and the other slidable thereon, and manually operated spring pressed latch means to maintain said discs in close relation with each other to hold the umbrella in raised open position when desired, and releasable to permit separation of said discs to permit collapse and closing of the umbrella.

4. A combination umbrella and purse, as described in claim 1, wherein the stand-off means comprises an upper and lower element, the upper element being fixed to the mast, and the lower element being slidable thereon, the inner ends of the ribs forming the frame being pivotally mounted on the stand-off means, and releasable means to support the upper and lower elements of the stand-off means in relatively close relation with each other whereby to maintain the umbrella in raised and open position, and to permit separation of the stand-off means whereby the umbrella may assume said lowered and closed position.

5. The combination of an umbrella and purse comprising a main mast, a flexible umbrella frame operatively arranged at one end of said mast such that said flexible umbrella frame collapses and lowers to a closed position, spacing stand-off means to maintain said flexible umbrella frame in spaced apart relation with respect to said main mast when the umbrella frame is collapsed and lowered, a purse having side walls and being arranged at the opposite end of said mast and surrounding said mast, a distance of said side walls of said purse from said mast and a distance at which said flexible frame of said umbrella is maintained from said mast by said spacing stand-off means being approximately equal to permit said flexible umbrella frame to surround said purse and envelope said purse in said closed position.

6. A combination umbrella and purse comprising a two part main supporting mast, the mast having an upper part and a lower part, the upper part of said mast arranged to telescope in relation to the lower part thereof, said umbrella having a flexible umbrella frame and a canopy being supported on said flexible umbrella frame, said flexible umbrella frame being operatively arranged at the upper part of said mast and being operated between an open and raise and a lower and close position, a pair of stand-off spacer elements surrounding and operatively associated with the upper part of said mast which elements are adapted to maintain the flexible umbrella frame in juxtaposed stand-off spaced apart relation with regard to said main supporting mast when the umbrella is in either opened and raised or lowered and closed position, a purse surrounding and operatively joined to the lower part of said mast, the width of said purse being approximately the same as the width of said stand-off spacer elements, and said flexible umbrella frame surrounding and enveloping said purse when the upper and lower parts of said mast are telescoped together and the umbrella closed and lowered.

7. A combination umbrella and purse, as described in claim 5, including spring means to aid in separating the pair of stand-off spacer elements.

8. A combination umbrella and purse, as described in claim 5, including spring latch means to maintain the two part main mast in extended position and other spring latch means to maintain the two part main mast in telescoped contracted position.

9. A combination umbrella and purse, as described in claim 5, wherein opening means is provided at each end of the purse to permit access thereto and closure fastening means is also provided at each end to maintain said opening access means in closed position, as desired.

10. A combination umbrella and purse comprising a two part telescopically extendible and contractible mast having a flexible umbrella frame and cover supported in an upper part of said mast, a purse surrounding and operatively associated with a lower part of said mast, a container surrounding said mast and located within said purse to receive the completely collapsed and folded umbrella frame and cover when the two parts of the mast are telescoped in the completely contracted position, and said purse having a carrying means at a lower end for carrying the umbrella and the purse in a reversed position.

* * * * *